United States Patent [19]

van Lieshout

[11] 4,171,500

[45] Oct. 16, 1979

[54] ELECTRIC LAMP

[75] Inventor: Johannes M. J. van Lieshout, Eindhoven, Netherlands

[73] Assignee: U.S. Philips Corporation, New York, N.Y.

[21] Appl. No.: 879,480

[22] Filed: Feb. 21, 1978

[30] Foreign Application Priority Data

May 16, 1977 [NL] Netherlands ..... 7705365

[51] Int. Cl.[2] ..... H01J 5/50

[52] U.S. Cl. ..... 313/331; 174/50.58; 313/332; 313/219

[58] Field of Search ..... 313/331, 332, 219; 174/50.58

[56] References Cited

U.S. PATENT DOCUMENTS

| | | | |
|---|---|---|---|
| 2,245,394 | 6/1941 | Francis et al. | 174/50.58 |
| 3,132,279 | 5/1964 | Lewin | 313/219 X |
| 3,278,778 | 10/1966 | Retzer | 313/332 X |

FOREIGN PATENT DOCUMENTS

| | | | |
|---|---|---|---|
| 42-18716 | 4/1967 | Japan | 313/219 |

*Primary Examiner*—Saxfield Chatmon, Jr.
*Attorney, Agent, or Firm*—Robert S. Smith

[57] ABSTRACT

Electric lamps having a simple, strong and reliable current lead-through construction according to the invention have, on a tungsten lead-through conductor, a first glass layer on which and between the ends of which a second glass layer is provided. The wall of the lamp vessel is fused to the second layer. Glasses having at least 95% by weight of $SiO_2$ are used for the layer and also for the wall of the lamp vessel.

4 Claims, 4 Drawing Figures

ELECTRIC LAMP

The invention relates to an electric lamp having a glass lamp vessel through the wall of which tungsten current lead-through conductors having a diameter D are passed in a vacuum-tight manner to an electric element situated inside the lamp vessel, each current lead-through conductor having thereon a first glass layer of thickness d, a second glass layer of smaller length being provided on and between the ends of said first layer, and fused thereto, the wall of the lamp vessel being fused to said second layer, the surfaces of the current lead-through conductor and the first layer, of the first layer and the second layer, and of the second layer and the wall of the lamp vessel each enclosing an angle of at least 90° in places where they meet.

One such lamp of the type defined above is disclosed in Netherlands Patent Specification No. 61573.

In the known lamp, a first layer of quartz glass is situated on the tungsten current lead-through conductor and has a thickness d of at most 240 μm in the case of current lead-through conductors having a diameter D of less than 600 μm and has a thickness in the case of thicker current lead-through conductors which satisfies the formula $$d \leqq 240\ \mu m + (D-600) \times 0.16\ \mu m.$$

According to said Patent Specification, a second layer of quartz glass or another kind of glass is provided on the first layer of quartz glass. For that purpose, a glass may be used for the second layer which is compatible with the glass of the wall of the lamp vessel.

When designing the seal of a current lead-through conductor through the wall of a lamp vessel, the problem is always encountered that the coefficients of expansion of metal and glass differ considerably. Said differences become extremely large, if, with a view to chemical and thermal resistance, tungsten has to be chosen as the metal (coefficient of expansion $45 \times 10^{-7°}$ K.$^{-1}$) and a glass has to be chosen having a very high silicon dioxide content (coefficient of expansion in the same temperature range in the order of magnitude of $10 \times 10^{-7°}$ K.$^{-1}$), for example quartz glass (coefficient of expansion $7 \times 10^{-7°}$ K.$^{-1}$). These differences play such an important part because the lamps are manufactured at very high temperature, are stored at room temperature and are operated at high temperature. A high pressure, which may be a few tens of atmospheres, prevails in the lamps in operating conditions. Not only must the seal withstand said pressure, it must also be gastight at high and low temperatures.

In spite of the availability of the construction according to the above referred to Netherlands Patent Specification, in practice substantially only lead-through constructions of the type, disclosed in German Auslegeschrift No. 1 489 472 are used, in which several intermediate glasses of decreasing coefficients of expansion are provided between the current lead-through conductor and the wall of the lamp vessel. Such expensive constructions are used in special, highly loaded halogen incandescent lamps and short-arc high-pressure discharge lamps.

Generally, in halogen incandescent lamps and in high-pressure mercury discharge lamps having a lamp vessel of quartz glass, a construction is used in which a thin molybdenum foil is incorporated in the pinch seals of the lamp vessel and to opposite ends of which a respective (tungsten) current conductor is welded (see, for example, Netherlands Patent Application No. 7406637 laid open to public inspection). In this construction the vacuum-tight seal is situated on the foil between the two current conductors welded thereon, this in spite of the high coefficient of expansion of molybdenum but due to the shape of the foil and the high ductility of molybdenum. The differences in coefficients of expansion between the current conductors and the quartz glass, however, cause the presence of capillary ducts around the current conductors. Through said ducts, aggressive gases can reach the molybdenum foil and attack same. As a result of this cracking may occur.

The reason that the said two constructions, namely that with several intermediate glasses and that with molybdenum foils, are still generally used is due to the fact that the construction according to the said Netherlands Patent Specification No. 61573 does not give satisfactory results in many cases in practice.

It is the object of the invention to provide electric lamps having a simple, strong and reliable lead-through construction.

According to the invention this object is achieved in electric lamps of the kind defined above in that the wall of the lamp vessel and the two glass layers on the current lead-through conductors consist, for more than 95% by weight, of silicon dioxide, that the ratio $D/(D+2d)$ is at least 0.7 and and that the surface of the second glass layer, on either side of the seal with the wall of the lamp vessel, extends parallel to the surface of the current lead-through conductor.

Glasses having a silicon dioxide content of more than 95% by weight, for example quartz glass and "Vycor", are considered (due to their high softening point and large chemical resistance) for use in halogen incandescent lamps (in which the "electric element situated inside the lamp envelope" is a filament) and in high pressure discharge lamps (in which the electric element is formed by a pair of electrodes) such as high-pressure mercury vapour discharge lamps, with or without the addition of a halide.

It has been found that only very low tensile stresses are present in lamps according to the invention in the proximity of the current lead-through conductor in the glass at its interface on the outside with the ambient atmosphere and on the inside with the contents of the lamp vessel. As a result of this the lamps are mechanically very strong. They can withstand high current densities and large temperature fluctuations. The lamp vessel of a discharge lamp according to the invention was cut by a saw at some distance from the place where the current lead-through conductor passes through the wall. The current lead-through conductor with the part of the lamp vessel connected thereto was held in a horizontal position and supported only at its ends. Near the saw-cut, a steel wire was laid over the lamp envelope and was loaded further and further with weights until fracture occurred in the part of the lamp. Surprisingly, the seal of the current lead-through conductor through the wall of the lamp vessel was still entirely intact when said fracture, which was located in the tungsten lead-through wire in a place situated outside the first glass layer, had occurred.

This rigidity of the construction is determined not only by the first glass layer of the current lead-through conductor, but by the geometry of the whole seal. However, there exists a wide tolerance.

The ratio between the lengths of the first and second glass layers is of little significance. What is of importance is that the second layer is shorter than the first and is situated between the ends of the first; that is to say that the first layer extends beyond the ends of the second layer. In order to realize this in mass production with sufficient certainty and while avoiding rejects, the first layer is preferably chosen to be at least a few millimeters (for example 4) longer than the second.

As regards the length of the second layer, it is of importance that this should be sufficiently long that, on either side of the junction of the wall of the lamp vessel and the second layer, the latter has a surface which extends parallel to the surface of the current lead-through conductor for a short distance. Again, with a view to a adequate tolerances in the manufacture, the length of the second layer is chosen to be able to meet this requirement. The length of said layer is preferably chosen to be equal to 4–7 times the wall thickness of the lamp vessel.

The thickness of the second layer is so chosen that, in mass production of the lamps, no damage to the envelopes can occur upon sealing the wall of the lamp vessel to the second layer as a result of the heat source used. On the other hand, the thickness of the second layer is not chosen to be so large that, having regard to the inside diameter of the lamp vessel, no smooth transition of the surfaces of the wall of the lamp vessel into the surface of the second layer is possible. As a rule the thickness of the second layer is $\frac{1}{3}$ of the diameter of the current lead-through conductor.

It is to be noted that in the description of the noted Netherlands Patent Specification No. 61573, reference is made to "Physics" 5, 384–404 from which it is said to be known that—in order to obtain low tensile stresses upon sealing tungsten wire in quartz glass—the thickness of the layer may not be more than $1\frac{1}{2}$% of the diameter of the tungsten wire. In practice, however, this teaching cannot as a rule be realized, since this implies extremely thin layers.

The tensile stresses referred to in this article are the tensile stresses occurring at the interface of the enveloped wire and the enveloping glass. The tensile stresses were assumed to be decisive of the quality of the seal.

The invention is based on the recognition of the fact that, for the resistance of a seal to cracking, it is not the tensile stresses at the metal to glass interface, but those at the glass to gas interface, that is to say those at interface glass to atmospheric gas and those at the interface glass to the gas in the lamp vessel, are of importance.

In contrast with the article in Physics which relates only to a metal wire having a glass layer which is equally thin everywhere, the invention relates to a tungsten wire which is sealed in the wall of a lamp vessel of a glass having a very low coefficient of thermal expansion. The teaching given in "Physics" of a very thin glass layer, which in many cases cannot be realized in practice, does not in itself result in such crack-resistant seals. The whole geometry of the seal is decisive of this.

The thickness of the first glass layer is preferably chosen such that $D/(D+2d) \leqq 0.85$. It has been found that in otherwise equal circumstances the said tensile stresses around the seal of the conductor in the wall of the vessel decrease even further according as the ratio $D/(D+2d)$ approaches the value 1 more closely. High ratio values can be achieved by choosing the first layer to be as thin as possible, for example 40 μm. In realizing a high ratio value the designer of the lamps is still aided by the fact that comparatively thick current supply conductors are usually chosen. This is due to the high current strengths which usually occur in current lead-through conductors or due to a large mechanical rigidity which the current lead-through conductors should be given so as to be able to support heavy electrodes in order to obtain a reasonable resistance to vibration or to give the current lead-through conductor rigidity to make them serve as contact pins for the connection of the lamp to contact terminals. As a rule the diameter is at least 500 μm. Current conductors of 700 μm are used in many lamps while in very highly loaded lamps thickness of a few millimeters is not exceptional. Therefore, with a first glass layer of 40 μm thickness, ratio values of 0.86, 0.89 and 0.98, respectively, can be realized for current conductors having a thickness of, for example, 500, 700 and 6000 μm.

According to the described Netherlands Patent Specification No. 61573 the wall of the lamp vessel in the immediate proximity of the seal should be at right angles to the current lead-through conductor. According to the invention, however, the wall of the lamp vessel in the immediate proximity of the seal may be inclined with respect to the current lead-through conductor. This involves the advantage of simplification in the manufacture of the lamps. In order to cause the wall of the lamp vessel to taper at an angle of less than 90° on the enveloped current lead-through conductor, a smaller glass displacement is necessary. The fusing of the wall of the lamp vessel to the second glass layer is furthermore easier in so far as the glass portions situated inside the lamp vessel are concerned.

The lamps according to the invention can be manufactured inter alia by means of known techniques. The glass layers around the current lead-through conductors can be provided by means of a method described in Netherlands Patent Specification No. 7409432 (PHN 7639) laid open to public inspection. It has been found that the first glass layer can be provided directly on the tungsten surface of a drawn wire without first polishing the wire.

Lamps according to the invention may be short-arc discharge lamps or high-pressure wall-stabilized discharge lamps, for example, high-pressure mercury discharge lamps with or without halide additions to the gas filling. Alternatively, however, the lamps may be incandescent lamps, for example halogen incandescent lamps, such as floodlight lamps, infrared lamps, photolamps, projection lamps and incandescent lamps for other applications.

Embodiments of lamps according to the invention will be described in greater detail with reference to examples and to the accompanying drawings, of which:

Figure 1:
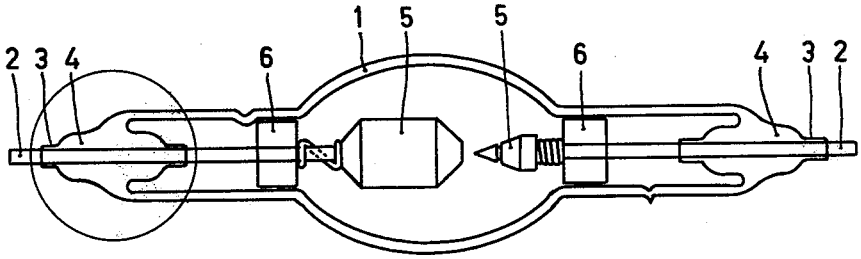
FIG. 1 shows a short-arc discharge lamp.

Reference numeral 1 in FIG. 1 denotes a quartz glass lamp vessel of a short-arc discharge lamp. Each of two current lead-through conductors 2 is provided with a first quartz glass layer 3 between the ends of which a shorter and thicker second quartz glass layer 4 is provided to which the wall of the lamp vessel 1 is sealed. The current lead-through conductors 2 each support a respective electrode 5. Quartz glass beads 6 provide a support for the current lead-through conductors 2.

Figure 2:
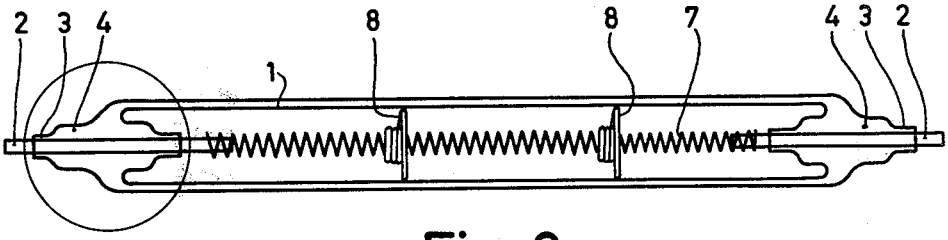
FIG. 2 shows an incandescent lamp.

In FIG. 2 corresponding components are referred to by the same reference numerals. The Figure shows a floodlight lamp in which the current lead-through conductors 2 are connected to a tungsten filament 7 which is centred in a tubular glass vessel by wire supports 8. The part of the current lead-through conductors 2 projecting outside the lamp vessel is coated with a metal, for example, aluminium, zinc, chromium, platinum or gold, so as to prevent corrosion during storage in moist conditions.

Figure 3:
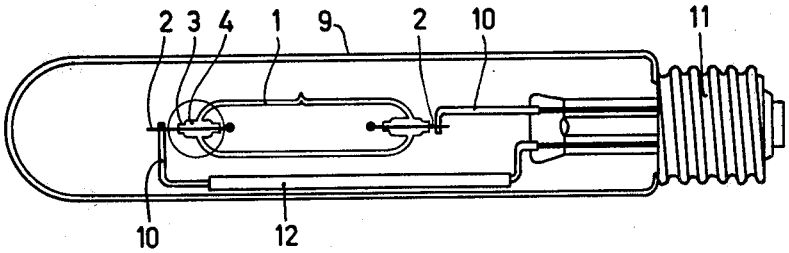
FIG. 3 shows a high-pressure mercury vapour discharge lamp.

FIG. 3 shows a high-pressure mercury vapour lamp in which the lamp vessel 1 is situated in an outer envelope 9. Pole wires 10 leading to the lamp cap 11 are connected to the current lead-through conductors 2. The longest pole wire 10 is surrounded by a ceramic tube 12.

Figure 4:
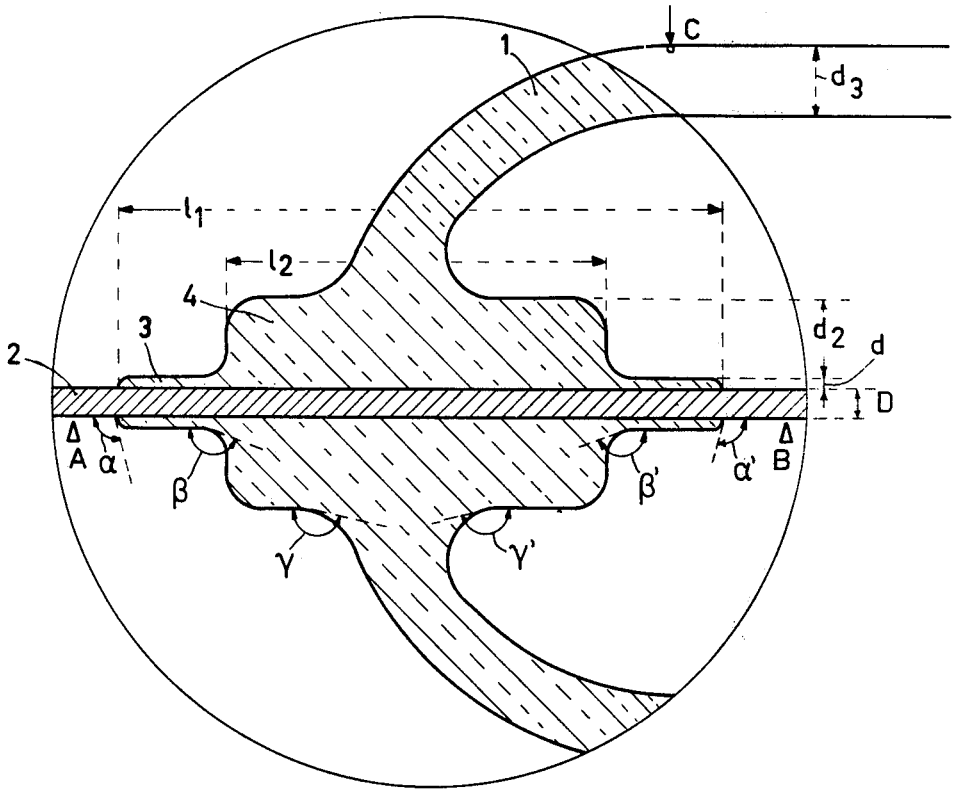
FIG. 4 is a sectional view on an enlarged scale of a detail of each of FIGS. 1 to 3.

FIG. 4 is a sectional view of the portion of the lamps which is shown ringed in FIGS. 1, 2 and 3. A first quartz glass layer 3 of thickness d is sealed on a tungsten wire 2 of diameter D. The layer 3 is sealed to a shorter second quartz glass layer of thickness $d_2$. The first layer 3 has a length $l_1$, the second layer 4 has a length $l_2$, and the wall of the quartz lamp vessel 1 has a thickness $d_3$.

In order to clarify the text, the corners formed by the surfaces of the current lead-through conductor and the first layer, of the first layer and the second layer, and of the second layer and the wall of the lamp vessel, respectively, in the places where these meet two by two are denoted in the Figure by $\alpha$ and $\alpha'$, $\beta$ and $\beta'\gamma$ and $\gamma'$, respectively.

Several seals of tungsten current lead-through conductors in quartz glass lamp vessels were made in accordance with the following table:

| D mm | | d mm | D/ D+2d) | $d_2$mm | $d_3$mm | $l_1$mm | $l_2$ mm |
|---|---|---|---|---|---|---|---|
| 1 | 0.6 | 0.08 | 0.79 | 0.25 | 1.3 | 15 | 8 |
| 2 | 1.25 | 0.08 | 0.89 | 0.3 | 1.3 | 18 | 9 |
| 3 | 3.4 | 0.17 | 0.91 | 0.3 | 3.0 | 20 | 15 |
| 4 | 1.0 | 0.08 | 0.86 | 0.35 | 1.4 | 17 | 8 |
| 5 | 1.25 | 0.12 | 0.84 | 0.3 | 1.3 | 18 | 9 |

EXAMPLE

A first quartz glass layer of 80 $\mu$m thickness and 15 mm length was provided on a tungsten wire of 600 $\mu$m diameter. For that purpose, a quartz glass tube was slid on the tungsten wire after which the assembly was heated in a nitrogen atmosphere by leading it through a high-frequency coil. The high-frequency field heated the tungsten wire which transmitted thermal energy to the inside of the quartz glass tube.

Present in the high-frequency coil was a non-short-circuited helical wire which was also heated by the high-frequency field and transmitted thermal energy to the outside of the quartz tube passed through the turns of said wire. Said quartz tube softened and adhered to the tungsten wire.

A second glass layer, having a thickness of 250 $\mu$m and a length of 8 mm, was then provided between the ends of the first glass layer on the tungsten wire by sliding a tightly-fitting quartz glass tube over the first layer and repeating the above-described operation. The second quartz glass tube in this manner was fused to the first quartz glass layer.

Two tungsten wires provided with respective layers formed in this manner were secured to the ends of a filament. A tubular quartz glass vessel having a wall thickness of 1.3 mm was slid over the assembly, which vessel was provided with a quartz glass exhaust tube extending transversely therefrom. The ends of the vessel were each sealed to the second glass layer of a respective tungsten wire in a nitrogen atmosphere. While the glass was still soft in the regions of the seals, the glass in these regions was blown out by building up a higher pressure in the resulting lamp vessel by means of nitrogen introduced via the exhaust tube so as to cause the surface of the glass of the second layer of the tungsten wires and the surface of the glass of the lamp vessel to join each other at an angle or more than 90°.

The resulting lamp envelope was evacuated and provided with a filling gas, after which the exhaust tube was sealed.

The above described method is also used when constructing discharge lamps.

What is claimed is:

1. An electric lamp which comprises: a glass vessel having a wall, first and second tungsten current lead-through conductors having external surfaces and a diameter D, said conductors extending through said wall in a vacuum-tight manner, an electric element disposed inside said lamp vessel which is connected to said conductors, said current lead-through conductors having a first glass layer of thickness d extending along a first axial portion of each conductor, a second glass layer disposed on said first glass layer extending along a second axial portion of each conductor, the axial extent of said second portion being intermediate and spaced from the axial extremities of said first portion, said second layer having an external surface, said first and second glass layers being fused together, said wall of said lamp vessel being fused to said second layer, said surfaces of each of said current lead-through conductors and said first layer, as well as of said first layer and said second layer, as well as of said said second layer and said wall of said lamp vessel enclosing at least one angle of at least 90° at the intersections thereof, said wall of said lamp vessel and said first and second glass layers consisting of more than 95% by weight of silicon dioxide, the ratio D/(D+2d) being at least 0.7, said surface of said second glass layer extending in the axial direction of each of said conductors (on either side of the seal between said wall of said lamp vessel and said second layer) parallel to said surface of each current lead-through conductor.

2. An electric lamp as claimed in claim 1 wherein the ratio D/(D+2d) is at least 0.85.

3. A lamp as claimed in claim 2 wherein said lamp is an electric discharge lamp.

4. A lamp as claimed in claim 2 wherein said lamp is an electric incandescent lamp.

* * * * *